United States Patent [19]

Turpin, Sr. et al.

[11] Patent Number: 4,499,456

[45] Date of Patent: Feb. 12, 1985

[54] DRIVER ALERT

[76] Inventors: Robert Turpin, Sr., c/o George Spector, 3615 Woolworth Bldg., 233 Broadway; George Spector, c/o Robert Turpin Sr., 3615 Woolworth Bldg., 233 Broadway, both of New York, N.Y. 10007

[21] Appl. No.: 323,660

[22] Filed: Nov. 20, 1981

[51] Int. Cl.[3] ..... G08B 21/00

[52] U.S. Cl. ..... 340/576; 16/114 R; 340/575

[58] Field of Search ..... 340/575, 576; 180/272; 296/152; 16/126, 112, 114 R, DIG. 24, DIG. 25

[56] References Cited

U.S. PATENT DOCUMENTS 2,187,761 1/1940 Torrens ..... 180/272

3,964,045 6/1976 Conley ..... 340/575

*Primary Examiner*—Glen R. Swann, III

[57] ABSTRACT

A handle device supportable on an automobile, and conveniently near a motorist, in order that he can pull himself up by applying a pulling force thereagainst, and the handle device also including an automatic alarm which is activated when the motorist starts to slump over.

4 Claims, 4 Drawing Figures

DRIVER ALERT

BACKGROUND OF THE INVENTION

This invention relates generally to automotive vehicle accessories.

More specifically it relates to pull handles.

It is well known that many motorists get sleepy while driving an automobile, particularly when alone, and they allow themselves to start slumping in their seat or over the steering wheel. This is a dangerous situation and is accordingly in need of improvement.

SUMMARY OF THE INVENTION

Therefore it is a principal object of the present invention to provide a device which allows motorists to pull himself up from a slumping position so that he does not start to fall asleep while driving an automotive vehicle, but stays awake.

Another object is to provide a Driver-Alert which may be quickly and easily installed in the inner side of the vehicle drivers window where it can be readily grasped when needed by the driver, in order to raise himself up.

Yet another object is to provide a Driver-Alert device which can serve as an exerciser.

DETAILED DESCRIPTION OF THE PREFERRED EMBODIMENTS

Figure 1:
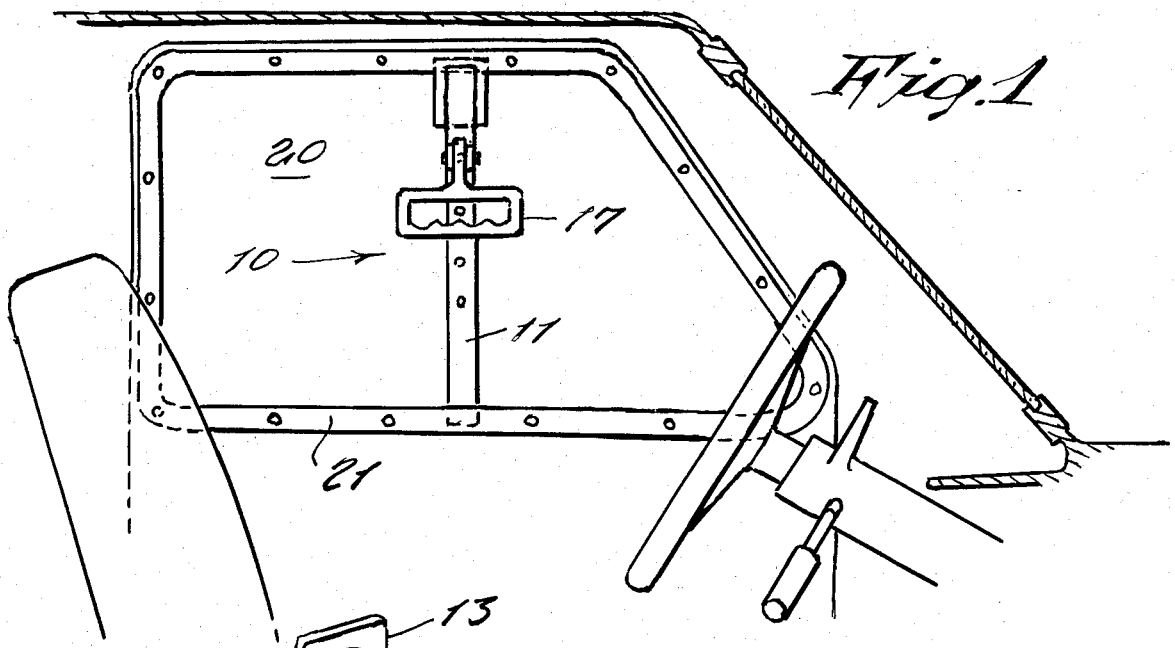
FIG. 1 is a view of the invention shown installed in an automobile window on a drivers side.
Figure 2:
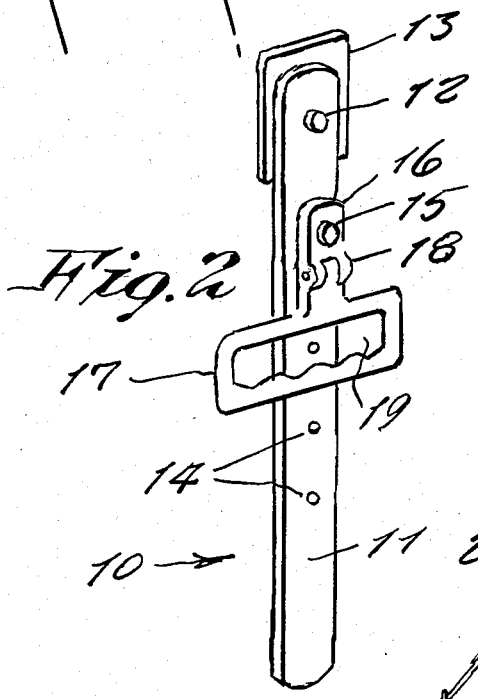
FIG. 2 is a perspective view of the invention shown alone.
Figure 3:
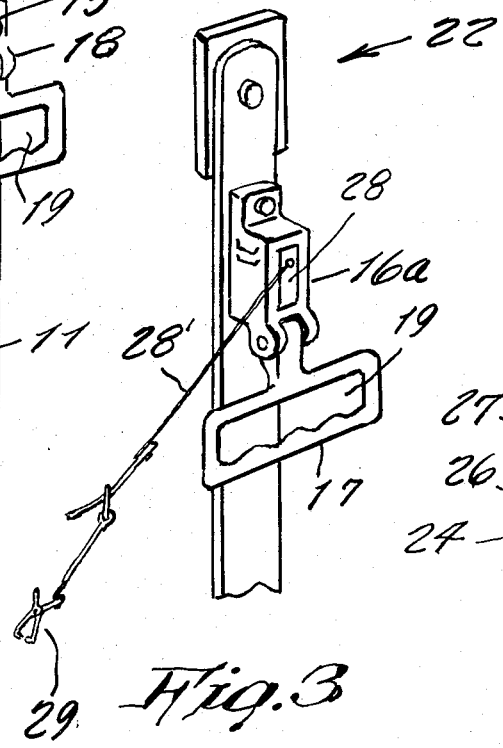
FIG. 3 is a similar view of another design thereof which additionally includes an automatic alarm so to warn the driver that he is slumping over, such as when starting to fall asleep.
Figure 4:
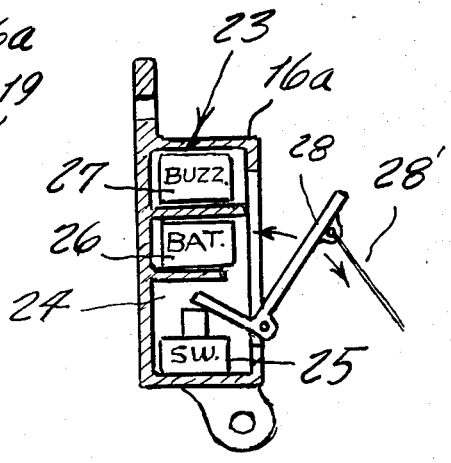
FIG. 4 is a cross sectional view of the alarm mechanism shown in FIG. 3.

Referring now to the drawing in greater detail, and more particularly to FIGS. 1 and 2 thereof, at this time, the reference numeral 10 represents a Driver-Alert, according to the present invention, wherein there is an elongated bar 11 made of clear plastic, and which at one end is attached by a bolt 12 to a pad 13. A row of spaced apart holes 14 along the bar are selectively used for a bolt 15 in order to rigidly secure a bracket 16 to the bar. A handle 17 is pivotally secured to the bracket by means of a hinge 18. The handle has an elongated, transverse hole 19 for receiving the fingers or hand of a user.

As shown in FIG. 1, the device may be installed across a window opening 20 of the vehicle, the upper end of the window frame 21 being grasped between the upper end of the bar and the pad, and the lower end of the bar resting against a lower end of the window frame. Thus in use, the driver may quickly and easily grasp the handle 17 for pulling himself up.

In a modified design 22 of the invention, it additionally includes an audible alarm 23 which automatically produces a sound when a driver starts to slump over, in order to arouse him. The alarm 23 is built into the above described bracket **16*a* wherein a hollow compartment 24 therein, contains an electric switch 25, a small dry cell battery 26 and an audible component such as either a bell or buzzer 27. A lever 28 for activating the switch, has an adjustable cord 28 connected at one end thereto, and the other end of the cord is fitted with a clip 29** for being connected to the drivers clothing such as either a hat, a collar of a shirt or coat, and the like. When the motorists starts to slump, the cord is thus pulled so as to sound the alarm.

While various changes may be made in the detail construction, it is understood that such changes will be within the spirit and scope of the present invention as is defined by the appended claims.

What is claimed:

1. A driver alert device for attachment to the interior of an automobile, at a location near a driver thereof, comprising in combination, an elongated bar which at its upper end includes means for mounting on said interior and a pull handle unit adjustably mounted to an intermediate portion of said bar, said device including a warning means for audibly warning said driver when the driver starts to slump over.

2. The combination as set forth in claim 1, wherein said warning means comprises an audible signal device and a cord secured to said driver and to a switch forming part of the warning means, whereby said switch is actuated to an operative position when the driver slumps over, thus sounding said audible signal device.

3. The combination as in claim 1 in further combination with a cord attached to the driver's clothes, said cord actuating said warning means when the driver slumps.

4. The combination of claim 3, wherein said warning means comprises a compartment housing batteries, an audible signal device, a switch and a pivotal member engaging said switch and wherein said pull handle is secured pivotally at said compartment bottom.

* * * * *